United States Patent [19]

Ragir et al.

[11] 4,387,811

[45] Jun. 14, 1983

[54] SHOWER SHELF

[75] Inventors: Meyer J. Ragir; Joseph B. Mayer, both of Chicago, Ill.

[73] Assignee: Selfix, Inc., Chicago, Ill.

[21] Appl. No.: 246,727

[22] Filed: Mar. 23, 1981

[51] Int. Cl.[3] ..... A47F 5/08

[52] U.S. Cl. ..... 211/119; 211/106

[58] Field of Search ..... 248/106, 119, 181, 302, 248/309 R

[56] References Cited

U.S. PATENT DOCUMENTS

| | | | |
|---|---|---|---|
| 1,039,359 | 9/1912 | Brown | 211/119 X |
| 2,518,549 | 8/1950 | Hyde | 211/106 X |
| 2,620,074 | 12/1952 | Moore, Jr. | 211/119 |
| 2,743,020 | 4/1956 | Rubenstein | 211/106 X |
| 3,088,597 | 5/1963 | Ritchey | 211/119 X |
| 3,115,107 | 12/1963 | Glenny | 211/106 X |
| 3,181,702 | 5/1965 | Raphael | 211/119 |
| 3,295,471 | 1/1967 | Cook | 211/106 X |
| 3,789,996 | 2/1974 | Stroh | 211/106 |

*Primary Examiner*—William E. Lyddane
*Assistant Examiner*—Peter A. Aschenbrenner
*Attorney, Agent, or Firm*—Dressler, Goldsmith, Shore, Sutker & Milnamow

[57] ABSTRACT

A wire shelf structure adapted to be supported from a shower arm and having a gripping portion that retains the structure in position againast movement along and rotation about the axis of said shower arm. The wire shelves include a peripheral lip to retain articles in place thereon, and the peripheral edge of the shelves may be attached directly to the frame of the structure to improve rigidity.

7 Claims, 5 Drawing Figures

SHOWER SHELF

TECHNICAL FIELD

The present invention relates to shelf structures and more particularly to shelf structures for use in a shower and adapted to be supported from the shower head pipe passing through the wall.

BACKGROUND OF THE INVENTION

Storage of personal care products in the shower has always presented a problem. There have been a variety of products introduced in the nature of shelves and racks which are designed for use in retaining personal care products such as soap, shampoos, washcloths, brushes and the like in the bath and shower.

For example, there are shelves designed to be positioned in the corner of the shower stall or bath area and attached to the walls at the corner. There have also been a variety of products designed to be hung from the shower pipe or shower arm between the shower head and the wall. While this type of product is very popular and very convenient to use by a person taking a shower, there have been a number of problems associated with such hanging storage racks and shelf structures.

One deficiency of many racks is the inability to store tall bottles such as for shampoo and hair conditioner. Another problem with many racks is that they are made from a solid material and therefore items such as soap tend to sit in a puddle of water from the shower spray deflected off of the body, which is obviously undesirable. Another deficiency has been the instability of many structures hanging from the shower arm when an off-center load is placed thereon causing it to tilt and oftentimes spilling the stored objects onto the floor. A related stability problem has been the tendency of the top of the rack hanging from the shower arm to move forward and off of the shower arm since a typical shower arm while extending from the wall on a horizontal plane bends downwardly so that the shower head is directed downwardly at an angle as is necessary for use.

Attempts have been made to overcome such stability problems. For example, many racks or structures include a separate piece mountable on the shower arm to restrain movement of the storage unit away from the wall. Attempts to prevent tilting have involved the use of separate mechanical fastening devices at the back of the rack, such as a suction cup, in order to hold the rack in its proper position.

None of these attempts have been totally successful and, as a result, while a variety of shower shelf structures and racks are on the market none truly satisfy the need of utility, stability and low-cost.

SUMMARY OF INVENTION

In accordance with the present invention, there is provided a shower shelf structure and storage unit which is simple, low in cost, which fits readily over the shower arm and when in place does not slide off of the arm nor rotate about the arm. As a result articles placed on the shelf unit remain in place and do not spill off.

More specifically, the shelf structure in accordance with the present invention is formed from a coated wire. A frame is formed from a pair of spaced apart parallel legs which taper toward each other at their upper end to define an inverted generally U-shaped gripping or retaining portion. The configuration of the gripping portion retains the rack on the shower arm against slippage and rotation when the rack is in place.

A plurality of shelves and retaining guard rails also made of coated wire extend between the vertical legs of the rack. The shelves are constructed with a peripheral raised edge to keep articles such as soap on the shelves from slipping off of the shelves. The shelves being constructed of spaced apart coated wires are not solid, and therefore, water is not retained in the shelf and the articles supported thereby have an opportunity to dry between use of the shower.

The lower extremities of the shelf structure legs may be bent at about a 90 degree angle to define hooks for holding appropriates articles such as brushes, washcloths and caps of the type that are more easily hung from a hook as distinguished from beomg supported on a shelf itself.

In accordance with one aspect of the invention, the stability provided by the design of the present invention allows the shelf to be constructed wider than normally possible since the antislip capabilities of the shelf of the present invention is so effective that even on wider shelves off-center loads do not result in the shelf to sliding or tilting. In conjunction with extra-wide shelf structure, the shelf units themselves are designed to provide extra rigidity which is, of course, more desirable as the shelf is built wider.

Thus the shower shelf unit and support structure of the present invention is constructed from a simple basic material, a coated rigid wire, is capable of being supported on the shower arm in a fixed position without rotation or slippage and for that reason can be built wider to provide greater capacity. At the same time the design of the shelf unit retains desired rigidity.

The shelvs are constructed with a peripheral raised edge to inhibit articles from falling off of the shelves and keep the articles stored where they are supposed to be. The resulting safe and stable shelving unit is well-suited to be used in shower stalls and baths.

Numerous other advantages and features of the invention will become readily apparent from the following detailed description of the invention and from the embodiments illustrated herein, from the claims and from the accompanying drawings.

DETAILED DESCRIPTION

Figure 1:
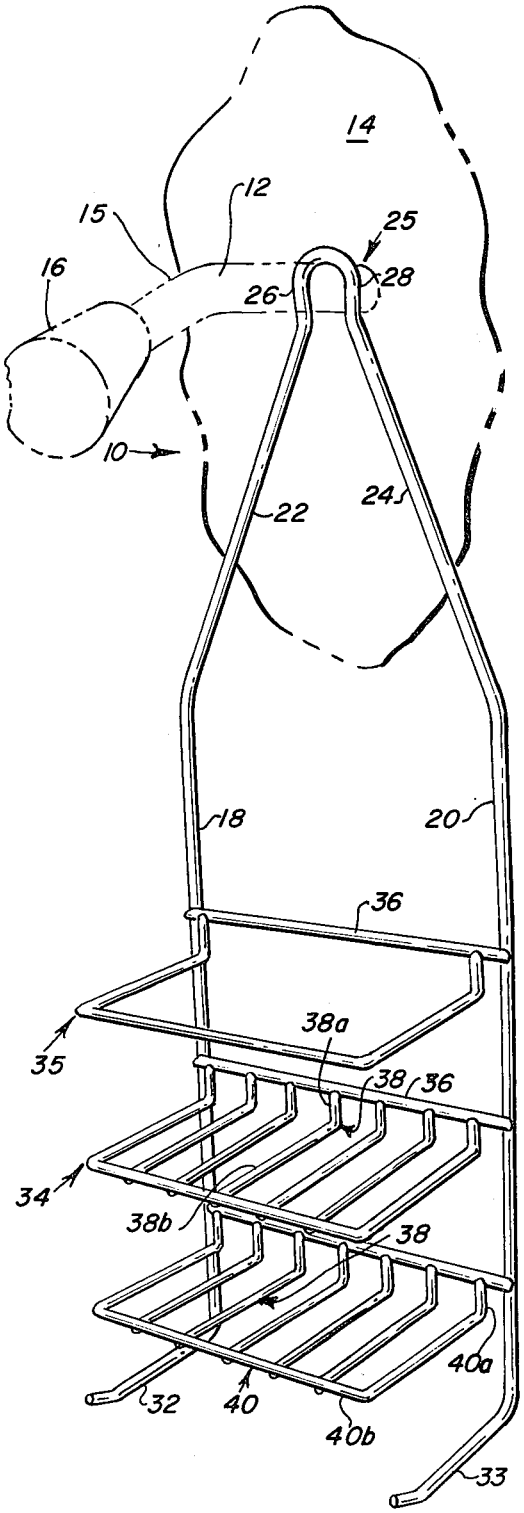
FIG. 1 is a perspective view of a shelf structure embodying the present invention in place on a shower arm.
Figure 2:
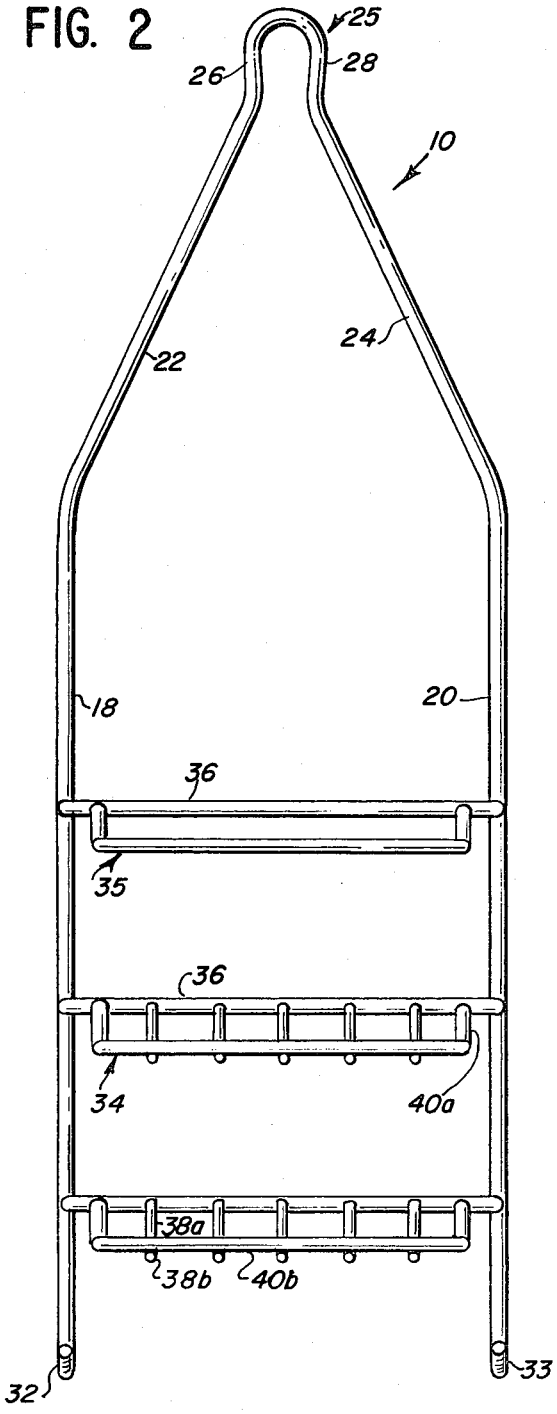
FIG. 2 is a front elevational view of a shower unit of the present invention.
Figure 3:
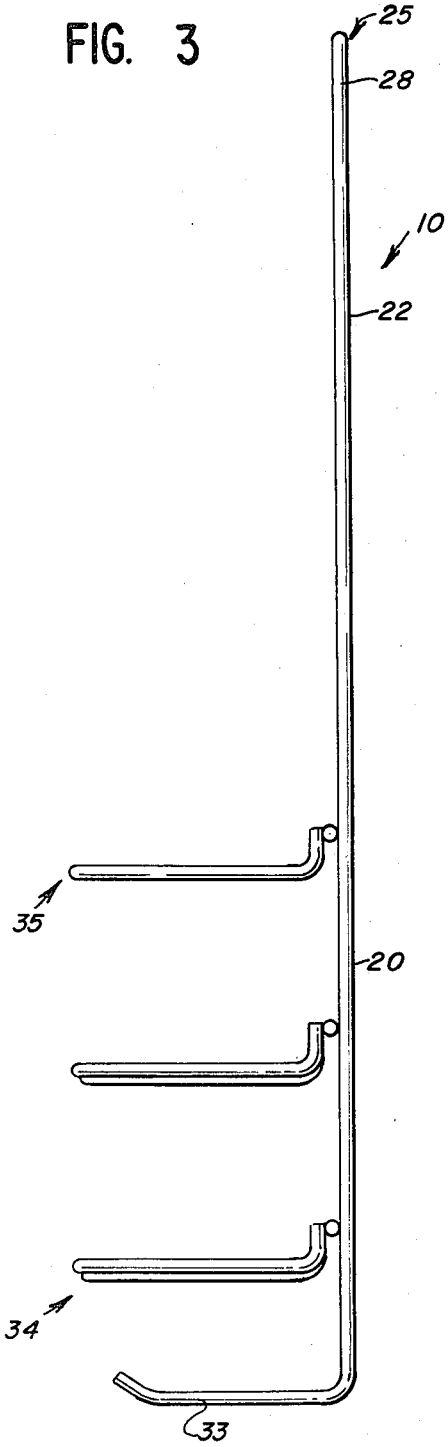
FIG. 3 is a side elevational view of the shelf structure.
Figure 4:
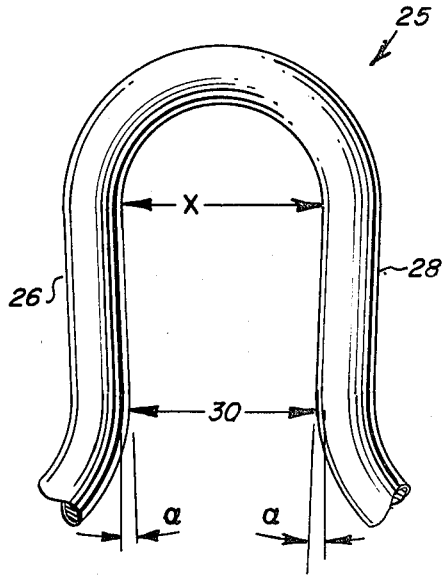
FIG. 4 is an enlarged front view of the upper pipe gripping portion of the shelf unit of the present invention.

While this invention is susceptible of embodiment in many different forms, there is shown in the drawing and will be described herein in detail, a specific embodiment and a modification thereof with the understanding that the present disclosure is to be considered as an exemplification of the principles of the invention and is not intended to limit the invention to the specific embodiment illustrated.

Referring to the drawing, FIG. 1 shows the shelf structure 10 of the present invention in position and supported from a shower arm 12 extending from a wall 14. As in the usual case, the arm extends horizontally out from the vertical wall and bends at 15 to a downward angle. The free end of the shower arm 12 has attached thereto a shower head 16.

The shelf unit 10 itself is formed from a relatively rigid wire or rod and typically is coated with a material such as a vinyl plastic. The shelf frame comprises a pair of spaced apart vertical frame members or vertical legs 18, 20. The upper ends 22, 24 of legs 18, 20 taper towards each other until at the top they merge into a generally inverted U-shape retaining or gripping portion 25. The arms 26, 28 of the upper retaining portion 25 taper towards each other to define a "throat" 30 at the point they merge into the flaring portions 22, 24 of the frame legs 18, 20. The lower end of each of the legs 18, 20 are bent at about a 90 degree angle to define hooks 32, 33 for various articles to be hung therefrom.

At various vertically spaced locations along the legs there are provided a plurality of wire frame shelves 34 and retaining bars 35 thereabove. Each of the shelves 34 and retaining bars 35 is attached to transverse or cross-member 36 extending between and affixed to the vertical legs 18, 20. Each shelf 34 is formed from a plurality of L-shaped spaced apart wires 38. The short leg **38*a* of each L-shaped wire is attached to and extends downwardly from cross-member 36. The long leg 38*b* extends forwardly from the plane defined by the vertical legs 18, 20. The periphery of each shelf is formed by a U-shaped wire 40 providing a shelf frame, the free ends of which 40*a* are bent upwardly as are the shelf wires 38, and are attached to te cross bar 36. Each of the inner L-shaped wires 38 is attached to the underside of the front portion 40*b* of the shelf frame 40. As a result the U-shaped shelf frame is raised above the internal shelf wires 38 to define a retaining lip for articles disposed on the shelf 34. Each retaining bar 35 is substantially identical to the shelf frame 40. Tall articles, e.g. bottles, placed on the upper shelf 34 extend upwardly within retaining member 35** which retains articles in place.

As indicated above, the upper retaining portion 25 of the shelf unit 10 is a generally inverted U in shape. However, the arms 26, 28 of the retaining portion 25 taper towards each other to define the throat 30 at the lower end thereof. The dimension between the arms 26, 28 at the throat 30 is less than the outer dimension of the typical shower arm 12. When the unit is installed over the shower arm and pulled downwardly so that the arms 26, 28 of the gripping portion 25 pass over either side of the shower arm 12, the arms 26, 28 are displaced outwardly and tightly frictionally grip the shower arm.

As a result of this gripping action, and without more, the shelf structure 10 of the present invention is retained in place. It does not slip forward nor does it tend to rotate about the axis of the shower arm even when an off-center load is placed on one of the shelves. The tendency of the shower unit to slip away from the wall is resisted by the configuration of the retaining portion 25 since the arms 26, 28 at the narrowest portion or throat 30, which typically is located below the lower surface of the shower pipe 12, resist such movement. The more the axis of the shelf 10 is tilted away from the perpendicular to the shower arm 12, the greater the frictional forces between the gripping portion 25 and the shower arm 12.

The desired tight fit is caused not only by the dimensions of the gripping portion 25, but also by the inwardly tapering arms 26, 28 which define it. The shelf unit of the present invention, therefore, is exceptionally stable and requires no additional fastening mechanisms either on the shower arm or along the length of the rack such as is common with many existing units.

Figure 5:
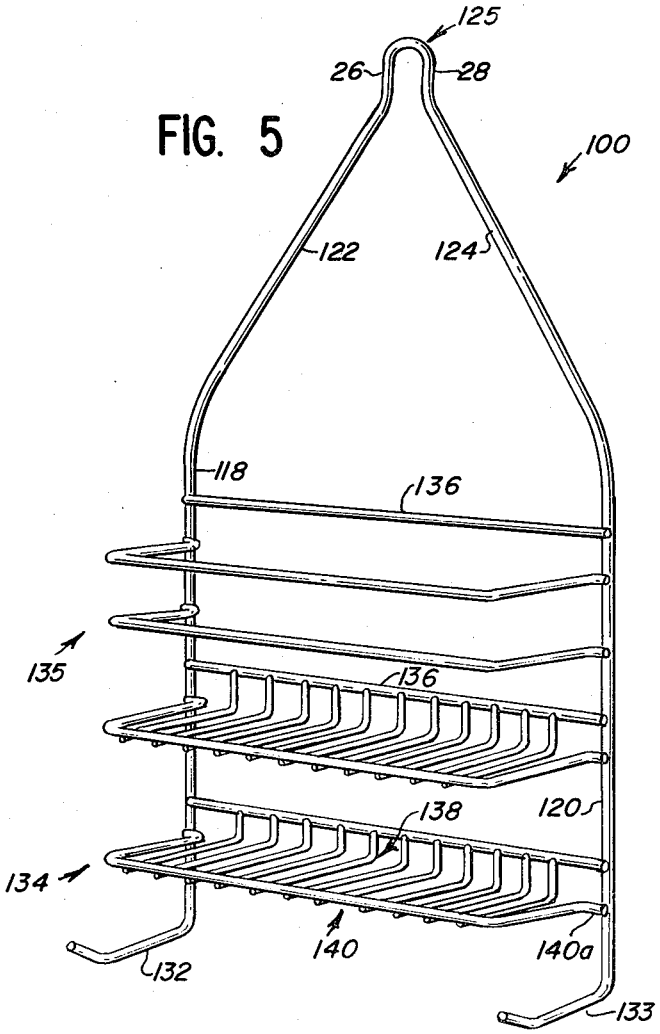
FIG. 5 is a perspective view of an alternative embodiment of the present invention.

Referring to FIG. 5, there is shown an alternative embodiment of a shower rack 100 incorporating the present invention which is in many respects the same as the embodiment shown in FIG. 1. The alternative embodiment is wider, i.e., the space between the vertical legs 118, 120 has been increased substantially. This greater width, resulting in increased capacity, is possible because of the stability of the unit resulting from the configuration of the gripping portion 125, which is the same in both embodiments.

Because of the greater width of the unit 100, additional rigidity is desired. Thus, the ends **140*a* of the peripheral lip-defining shelf frame 140, do not terminate in an upwardly bent portion attached to a crossbar as in FIG. 1, but are bent outwardly and attached to the vertical frames or legs 118, 120. This simple change substantially increases the rigidity of the shelves 132, as well as the overall unit. Since each shelf 132 is attached to the spaced apart vertical legs 118, 120** at two locations the rigidity of the shelves themselves and the overall unit is improved.

One of the features of the shelf unit of the present invention is that the peripheral shelf frame 40, 140 is constructed identically to the retaining bar 35, 135. Only the addition of the cross-member 36, 136 and shelf wires 38, 138 is needed for the shelf. Thus, quite a variety of configurations are possible without specially forming different components. Furthermore, the rigidity is provided without extra bars as the shelf frames themselves are attached to the legs of the shelf structure.

The shelf unit embodying the present invention is attached to the shower arm simply by guiding the open upper area 50 between the tapered portions 22, 24 over the shower head 15 with the retaining portion 25 disposed above the shower arm 12. A simple downward force on the shelf structure 10, 100 causes the retaining portion 25 to pass over the shower arm 12 with the throat 30 ultimately disposed immediately below the shower arm 12 and exerting a gripping force thereon to retain the shelf 10 or 100 in place.

Thus there has been disclosed a simple shelf structure for use in shower and bath and which is simple and can be easily suspended from and affixed to the shower arm without any extraneous components. The shelf structure of the presen invention when in place is exceptionally stable, does not slip along the length of the arm nor rotate about it, even when off-center loads are placed on the shelves. The shelves themselves are open wire structures to allow proper drainage and are provided with a peripheral frame member which acts as a lip to preclude articles from slipping off of the shelf.

In one embodiment, the shelf frame member and the retaining bars are affixed directly to the vertical legs of the shelf to provide rigidity to the overall structure and the shelves themselves.

As a result of the construction of the shelf unit in accordance with the present invention, the units may be made wider than has been the practice thus providing extra capacity without worrying about the stability of the unit or the tendency to rotate and cause spillage of articles therefrom.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. A shelf support structure adapted to be suspended from a shaft extending out from the surface of a wall comprising:

a frame comprised of a pair of spaced-apart generally vertical legs, the upper ends of which taper towards each other and merge into the lower ends of a pair of arms of a generally inverted U-shaped gripping portion adapted to be received over said shaft and to retain said shelf structure in place thereon, said vertical legs and said U-shaped gripping portion being formed from a single continuous member to provide the uppermost portion of said shelf structure with an uninterrupted closed configuration;

said arms of said gripping portion tapering towards each other from the base of the inverted U-shaped gripping portion to define at their lower ends a throat at which the spacing between said arms is less than the diameter of said shaft; and at least one shelf extending between and attached to said vertical legs for supporting articles thereon;

the configuration of said gripping portion coacting with said shaft to retain said structure in position and inhibit both displacement thereof along the axis of said shaft and rotation thereof about the axis of said shaft;

the configuration of the upper ends of said vertical legs and of said pair of arms acting to facilitate guided positioning of said shelf structure on said shaft so that said shaft is guided by said upper ends into said gripping portion when said shelf structure is positioned in relation to said shaft so that said shaft is disposed between said upper ends of said vertical legs, and said shelf structure is moved downwardly with respect to said shaft.

2. A shelf support structure as claimed in claim 1 wherein:

said tapered arms of said gripping portion at the throat coacting with the lower surface of said shaft to increase the retention force therebetween as the angle between the plane defined by said generally vertical legs and the axis of said shaft deviates from 90 degrees;

whereby displacement of said shelf structure along the axis of said shaft is inhibited.

3. A shelf support structure as claimed in claim 1 wherein said shelf is formed from a first transverse member extending between said spaced apart vertical legs and a plurality of spaced apart shelf wires having a first portion attached to said transverse member and extending down therefrom and a second portion bent at an angle to said first portion and extending substantially perpendicular to the plane defined by said frame legs.

4. A shelf support structure as claimed in claim 3 wherein said shelf structure includes a peripheral U-shaped shelf frame which generally defines the periphery of said shelf, the free ends of each of said shelf wires intersecting said peripheral shelf frame and being attached to the under surface thereof, whereby said shelf frame is located above said shelf wires to define a retaining lip for articles supported on said shelf.

5. A shelf support structure as claimed in claim 4 wherein the free ends of said shelf frame are respectively attached to said spaced apart vertical legs.

6. A shelf support structure as claimed in claim 5 including a generally U-shaped retaining member positioned above and generally aligned with said shelf, said retaining member acting to retain articles placed on said shelf.

7. A shelf support structure as claimed in claim 6 wherein said shelf structure comprises plastic-coated wire.

* * * * *